United States Patent [19]

Montes

[11] 4,348,021

[45] Sep. 7, 1982

[54] SHEET FEEDING APPARATUS

[75] Inventor: David M. Montes, Rochester, N.Y.

[73] Assignee: Xerox Corporation, Stamford, Conn.

[21] Appl. No.: 209,579

[22] Filed: Nov. 24, 1980

[51] Int. Cl.[3] ..... B65H 3/06; B65H 3/08

[52] U.S. Cl. ..... 271/112; 221/258; 221/259; 271/94; 271/120; 271/276

[58] Field of Search ..... 271/112, 94, 95, 96, 271/120, 119, 90, 11, 15, 194, 196, 276; 221/211, 277, 258, 259; 414/121

[56] References Cited

U.S. PATENT DOCUMENTS

| | | | |
|---|---|---|---|
| 3,403,904 | 10/1968 | Kim | 271/112 |
| 3,630,516 | 12/1971 | Hong | 271/120 X |
| 3,998,449 | 12/1976 | Hornung | 271/112 |
| 4,043,549 | 8/1977 | Rinehart | 271/118 |
| 4,121,819 | 10/1978 | DiFrancesco et al. | 271/96 |
| 4,127,263 | 11/1978 | Wenthe | 271/96 |

FOREIGN PATENT DOCUMENTS

| | | | |
|---|---|---|---|
| 54-18578 | 2/1979 | Japan | 271/112 |
| 54-35966 | 3/1979 | Japan | 271/94 |

*Primary Examiner*—Bruce H. Stoner, Jr.

[57] ABSTRACT

Sheet feeding apparatus including a cylindrical tube mounted above a stack of documents for separating individual documents from the stack. The cylindrical tube houses a rotatably mounted shaft to which are secured a series of spaced beater and turbine blades respectively. The cylindrical tube defines a series of apertures along its bottom surface which are aligned with the beater blades and allow the beater blades to extend outwardly into contact with a separated sheet. At one end of this cylindrical tube is coupled a vacuum source which when energized rotates the turbine blades and reduces the pressure inside the tube. Accordingly, a single sheet is first separated from the top of the stack by attraction toward the reduced pressure inside the tube and once separated is driven away from the stack by the beater blades mounted to the rotating shaft.

4 Claims, 7 Drawing Figures

80
110
112
68
62

80
110
84
114
112

80
82
92
7
6
5

SHEET FEEDING APPARATUS

BACKGROUND OF THE INVENTION

1. Field of the Invention

The present invention relates to a sheet feeder for moving sheets from a stack and more particularly relates to a simple vacuum assisted impact feeder for removing sheets from the top of such a stack.

2. Prior Art

In the copier art it is often necessary to automatically feed a series of documents or copy sheets from a stack of such sheets along a path of sheet travel to a processing station. In a typical operation, it is necessary that only one sheet be fed at a time from the stack along the paper path. It is therefore a requirement that some mechanism be provided to separate one sheet from the stack and initiate movement of that sheet away from the stack toward the processing station. Once an initial separation has been achieved, other drive mechanisms known in the art can be utilized to rapidly reposition the document or copy sheet for processing. These other sheet handling mechanisms can also be utilized to maintain proper sheet coordination and/or registration with other copier functions. Accordingly, it is often not necessary that the sheet separating mechanism accurately maintain sheet position as it is being separated from the stack.

The prior art sheet separating and movement initiating mechanisms can be roughly categorized as either impact, vacuum assisted, or a combination of impact and vacuum assisted mechanisms. All three sheet separating techniques have been tried with varying degrees of success. Each has its advantages and disadvantages and it is not believed any one of these generic sheet separating mechanisms can be categorically stated to be better than the others.

Those prior art mechanisms employing vacuum assisted separators only, are characterized by a source of vacuum which attracts one sheet away from a stack of such sheets and initiates movement away from the stack. Two examples of such a vacuum assisted sheet transport mechanism are disclosed in U.S. Pat. Nos. 4,121,819 and 4,127,263 to DiFrancesco et al and Wenthe, respectively. Both document transports illustrated in those patents are vacuum assisted transports which feed documents in sequence from the bottom of a stack of those documents. A bottom most sheet is attracted to a vacuum assisted drive roller which then drives the bottom most sheet away from the stack to a separate location for processing.

An impact type transport or feeder is one that relies solely upon frictional forces to engage sheets of paper to be transported and drive those sheets away from the stack. An example of such an impact type feeder is disclosed in U.S. Pat. No. 4,043,549 to Rinehart which has been assigned to the assignee of the present invention. The apparatus disclosed in that patent includes a paddle element which is rotated into contact with a bottom most sheet to initiate movement of that sheet away from the stack. Sheet separation is achieved by angled air jets which reduce the frictional forces between a bottom most and other sheets in the stack. Other examples of impact type only sheet transport mechanisms comprise paddle wheel elements which also intermittently engage a sheet or document to urge that sheet in a particular direction.

An example of a combined impact and vacuum assisted drive mechanism is shown in U.S. Pat. No. 3,998,449 to Hornung. The apparatus disclosed in that patent utilizes an impact device to first separate a bottom most sheet from a stack and then employs a vacuum assist to move a separated sheet away from stack for subsequent processing. Both vacuum and impact device are located on a single rotating drum element which coordinates sheet separation and movement.

Each of the techniques embodied by the aforementioned patents has achieved some degree of success in performing its primary purpose, i.e. sheet separation and movement initialization. Impact only type separators, however, often experience multiple feeds which in turn can lead to sheet jamming at subsequent processing stations. In vacuum assisted mechanisms some techniques must be employed to not only attract single sheets to the vacuum source but also to initiate movement of that sheet once the attraction has caused a sheet separation. To detect jams or to provide movement to a separated but as yet stationary sheet has necessarily made more complex prior sheet separation. It is accordingly at one object of the present invention to provide a simple yet reliable sheet separation and movement initialization mechanism.

SUMMARY OF THE INVENTION

The apparatus embodying the present invention is substantially less complex than prior art sheets separating and transport initiating apparatus. Practice of the invention resultes in a relatively simple sheet transport preferably utilized for separating and moving single sheets from the top of a stack of such documents.

According to the invention, the sheet feeding apparatus includes a cylindrical tube mounted in relation to a stack of documents. The tube defines one or more openings which communicate with a region directly above the stack. The tube is coupled to means for creating a pressure reduction inside the tube to attract individual sheets from a stack of such sheets through the one or more openings. Finally, the apparatus includes a drive means rotatably mounted inside the tube having portions which extend through the openings to contact individual sheets so attracted and move them along a desired path. According to a preferred embodiment of the invention, the means for creating a pressure reduction powers the drive means so that a separate source of driving power for the apparatus is not required.

The means for creating the pressure reduction preferably comprises a vacuum source which is coupled to the tube's interior. Rotatably mounted inside the tube is a shaft concentrically located and mounted for rotation about an axis coincident with a centerline of the cylindrical tube. The shaft serves as a mount for a series of turbine blades. The turbine blades are responsive to the vacuum source and initiate rotation of the shaft which in turn causes a series of beater blades attached to the shaft to rotate. The beater blades are aligned with the one or more openings along the cylindrical tube's length and extend a short distance beyond those openings. As the shaft is rotated in response to the vacuum source, the beater blades periodically extend through the openings to contact a paper sheet attracted to the tube by the vacuum source. In this way, both sheet separation and initial movement are achieved with a mechanism having only one moving member, the rotating shaft and accompanying turbine and beater blades.

The present sheet feeding apparatus reduces the incidence of multiple sheet feeding. If two or more sheets are removed from the stack and acquired by the tube, impact forces by the beater blades on the top sheet tend to drive excess sheets back onto the stack.

Apparatus constructed according to the invention is simple and reliable. When mounted above a stack of documents or sheets of paper, the vacuum assist separates a top most document to allow the beater blades to periodically rotate into contact with the separated sheet and drive it away from the stack. Once the sheet has been separated, other transports known in the art such as drive rollers or drive belts can be utilized to reposition the sheet for subsequent copier operation. Since these subsequent transports can be used to register, align, and control the timing of the sheet movement, the present transport need only achieve sheet separation and travel initiation.

In the preferred embodiment, the shaft beater and turbine blades all comprise easily constructed plastic material mounted within a metal housing. It should be readily apparent therefore that the cost in fabricating such a device is low. From the above it should be appreciated that one object of the invention has the provision of a reliable yet simple sheet separation and transporting mechanism which can be produced at a low cost while adequately performing the aforementioned desired functions. Other objects and advantages of the present invention will become more clearly understood when a detailed description of a preferred embodiment of the invention is considered in conjunction with the accompanying drawings.

DETAILED DESCRIPTION OF THE PREFERRED EMBODIMENT

Figure 1:
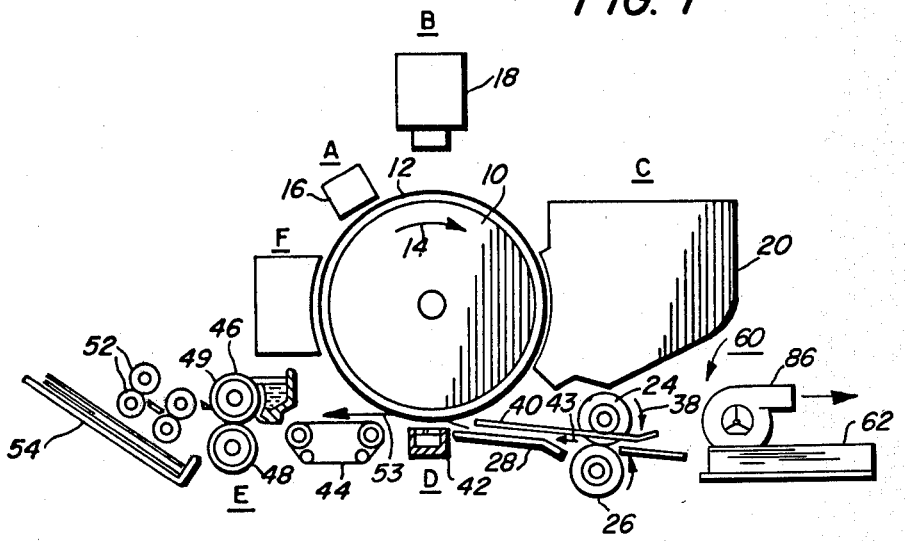
FIG. 1 is a schematic elevational view of an electrophotographic printing machine.

For a general understanding of an electrophotographic printing machine in which the features of the present invention may be incorporated, reference is made to FIG. 1 which depicts schematically the various components thereof. Although the apparatus for forwarding sheets along a predetermined path is particularly well adapted for use in the electrophotographic printing machine of FIG. 1, it should become evident from the following discussion that it is equally well suited for use in a wide variety of devices and is not necessarily limited in its application to the particular embodiment shown herein. For example, the apparatus of the present invention will be described hereinafter with reference to feeding successive copy sheets, however, one skilled in the art, will appreciate that it may also be employed for feeding successive original documents.

Since the practice of electrophotograhic printing is well known in the art, the various processing stations for producing a copy of an original document are represented in FIG. 1 schematically. Each processing station will be briefly described hereinafter.

As in all electrophotographic printing machines of the type illustrated, a drum 10 having a photoconductive surface 12 supported by the exterior circumferential surface of a conductive substrate is rotated in the direction of arrow 14 through the various processing stations. By way of example, photoconductive surface 12 may be made from selenium of the type described in U.S. Pat. No. 2,970,906 issued to Bixby in 1961. A suitable conductive substrate is made from aluminum.

Initially, drum 10 rotates a photoconductive surface 12 through charging station A. Charging station A employs a corona generating device, indicated generally by the reference number 16, to charge photoconductive surface 12 to a relatively high substantially uniform potential. A suitable corona generating device is described in U.S. Pat. No. 2,836,725 issued to Vyverberg in 1958.

Thereafter drum 10 rotates the charged portion of photoconductive surface 12 to exposure station B. Exposure station B includes an exposure mechanism, indicated generally by the reference numeral 18, having a stationary, transparent platen, such as a glass plate or the like for supporting an original document thereon. Lamps illuminate the original document. Scanning of the original document is achieved by oscillating a mirror in a timed relationship with the movement of drum 10 or by translating the lamps and lens across the original document so as to create incremental light images which are projected through an apertured slit onto the charged portion of photoconductive surface 12. Irradiation of the charged portion of photoconductive surface 12 records an electrostatic latent image corresponding to the information areas contained within the original document.

Drum 10 rotates the electrostatic latent image recorded on photoconductive surface 12 to development station C. Development station C includes a developer unit, indicated generally by the reference numeral 20, having a housing with a supply of developer mix contained therein. The developer mix comprises carrier granules with toner particles adhering triboelectrically thereto. Preferably, the carrier granules are formed from a magnetic with the toner particles being made from a heat settable plastic. Developer unit 20 is preferably a magnetic brush development system. A system of this type moves the developer mix through a directional flux field to form a brush thereof. The electrostatic latent image recorded on photoconductive surface 12 is developed by bringing the brush of developer mix into contact therewith. In this manner, the toner particles are attracted electrostatically from the carrier granules to the latent image forming a toner powder image on photoconductive surface 12.

With continued reference to FIG. 1, a copy sheet is advanced by a sheet feeding apparatus or transport 60 to transfer station D. Sheet feeding apparatus 60 advances successive copy sheets to forwarding rollers 24 and 26. Forwarding roller 24 is driven by a motor (not shown) in the direction of arrow 38 and roller 26 rotates in an opposite sense when roller 24 is in contact therewith. In operation, feeding apparatus 60 operates to advance the uppermost sheet from stack 62. At this time, rollers 24 and 26 are spaced from one another. This defines a gap through which the leading edge of the sheet moves. After the leading edge of the sheet is positioned in this gap, rollers 24 and 26 move into contact with the sheet so as to advance the sheet in the direction of arrow 43. The sheet is advanced through a chute formed by guides 28 and 40 to transfer station D. The detailed structure of forwarding rollers 24 and 26 is described in commonly assigned U.S. application Ser. No. 890,176, filed Mar. 27, 1978 in the name of Abraham Cherian, now abandoned. However, in general, the rollers move into and out of contact with the sheet depending upon whether they are waiting for a sheet to be advanced into the gap. Thus, if the sheet is being advanced thereto, the rollers are spaced from one another defining a gap for receiving the sheets. Contrawise, when the rollers are advancing a sheet, they are moved into contact with the sheet so as to advance it.

Continuing now with the various processing stations, transfer station D includes a corona generating device 42 which applies a spray or ions to the back side of the copy sheet. This attracts the toner powder image from photoconductive surface 12 to the copy sheet.

After transfer of the toner powder image to the copy sheet, the sheet is advanced by endless belt conveyor 44, in the direction of arrow 53, to fusing station E. Fusing station E includes a fuser assembly indicated generally by the reference numeral 46. Fuser assembly 46 includes a fuser roll 48 and a backup roll 49 defining a nip therebetween through which the copy sheet passes. After the fusing process is completed, the copy sheet is advanced by rollers 52, which may be of the same type as forwarding rollers 24 and 26, to catch tray 54.

Invariably, after the copy sheet is separated from photoconductive surface 12, some residual toner particles remain adhering thereto. These toner particles are removed from photoconductive surface 12 at cleaning station F. Cleaning station F includes a corona generating device (not shown) adapted to neutralize the remaining electrostatic charge on photoconductive surface 12 and that of the residual toner particles. The neutralized toner particles are then cleaned from photoconductive surface 12 by a rotatably mounted fibrous brush (not shown) in contact therewith. Subsequent to cleaning, a discharge lamp (not shown) floods photoconductive surface 12 with light to dissipate any residual electrostatic charge remaining thereon prior to the charging thereof for the next successive imaging cycle.

Figure 2:
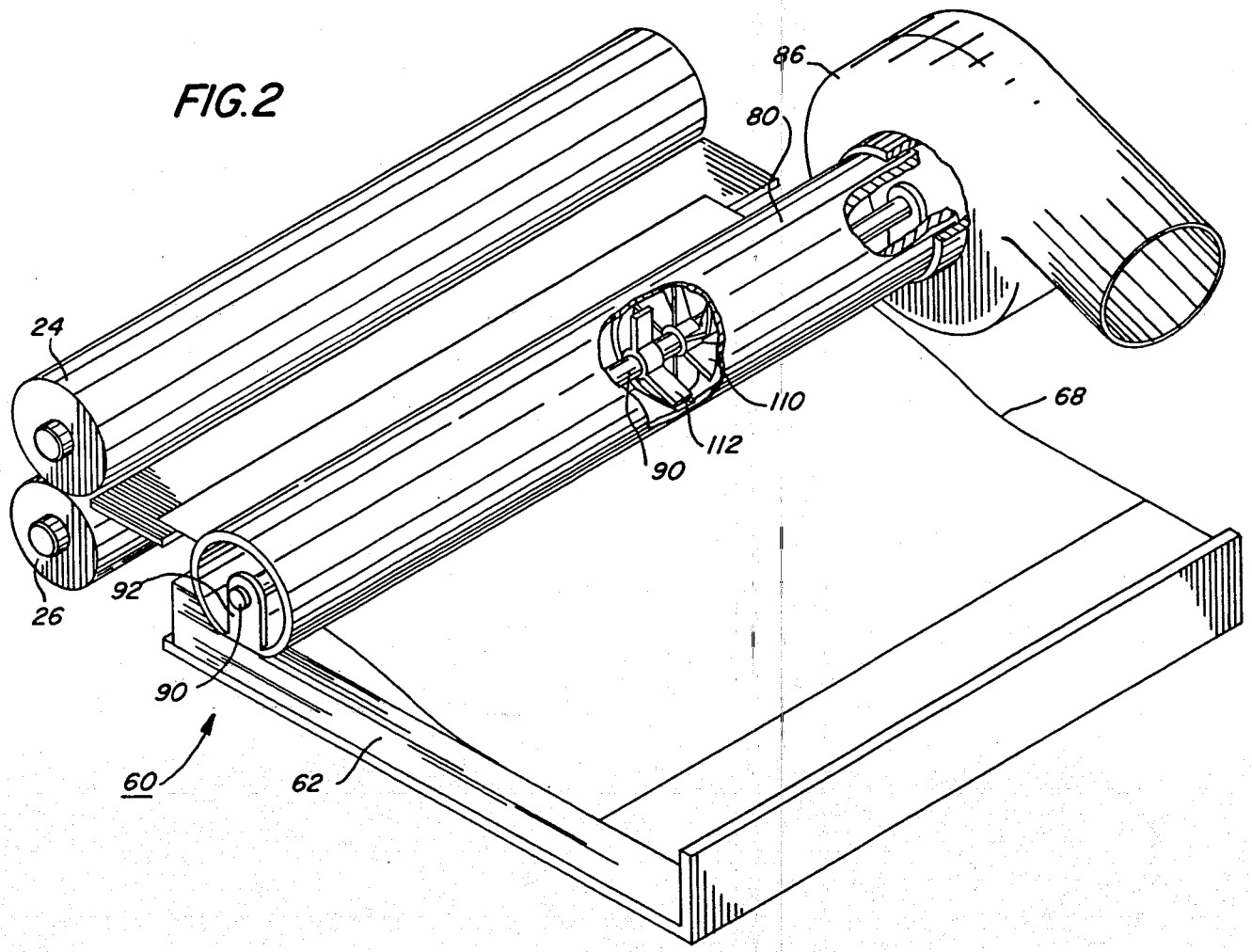
FIG. 2 shows a perspective schematic of a sheet transport constructed in accordance with the present invention.
Figures 3, 4, 5:
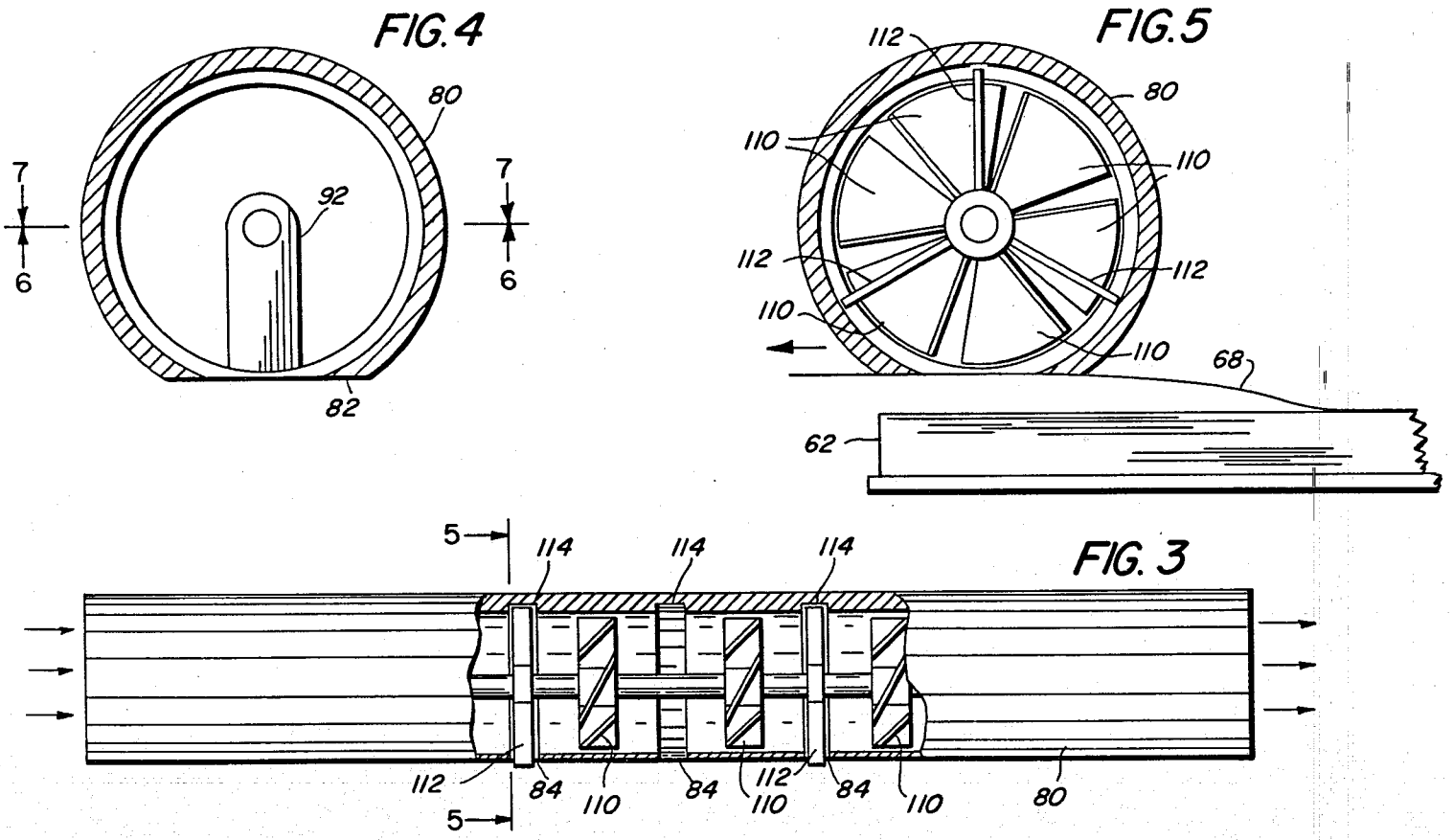
FIG. 3 is a partially sectioned elevational view of a turbine housing for the present invention.
FIG. 4 is an end view of the FIG. 3 housing.
FIG. 5 is a view taken along the line 5—5 of FIG. 3.
Figure 6:
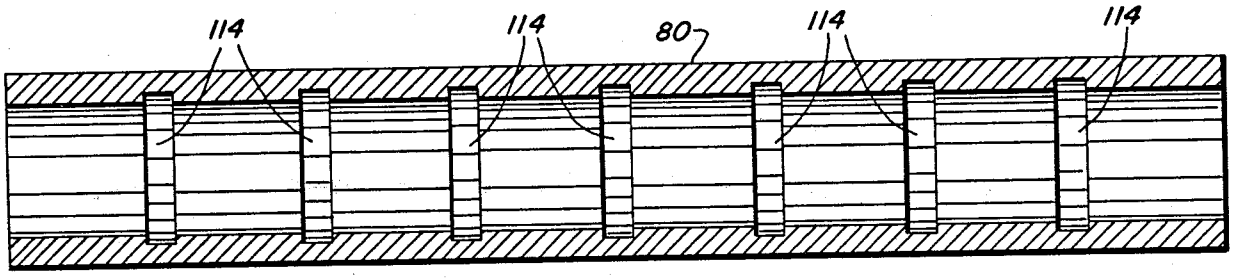
FIG. 6 is a view taken along the line 6—6 of FIG. 4.

It is believed that the foregoing description is sufficient for purposes of the present application to illustrate the general operation of an electrophotographic printing machine. Referring now to the specific subject matter of the present invention, FIG. 2 depicts the top feeder system in greater detail.

FIG. 2–7 illustrate the sheet transport 60 for separating individual sheets from a stack 62 and imparting initial movement of the separated sheet away from the stack. The transport 60 is mounted above the stack 62 and as successive sheets are removed from the stack the transport 60 can be lowered or alternatively the stack 62 can be raised so that the transport 60 continues to function as the height of the stack diminishes.

The transport 60 attracts an individual sheet 68 away from the stack 62 and moves the sheet to the gap formed by the pair of rollers 24, 26. As noted previously, engagement of the sheet by the rollers 24, 26 causes the sheet to move to the transfer station D. Although one application of the present invention is for use in a xerographic copier it should be appreciated that the present transport 60 could be utilized to engage and drive any light weight sheet which typically would comprise a paper material. In a xerographic environment the transport 60 can advantageously be utilized for separating either copy sheets to which a toner image is transferred or document originals from which the toner image is created. The transport 60 comprises a hollow cylindrical tube 80 which has been truncated along its length so that a flat tube surface 82 faces the stack 62.

Figure 7:
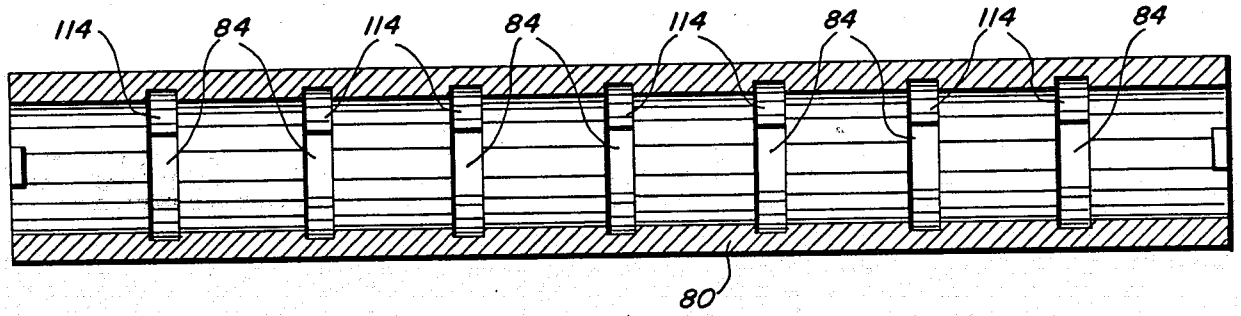
FIG. 7 is a view taken along the line 7—7 of FIG. 4.

Spaced intermittently along this surface 82 are a series of apertures 84 (FIG. 7). A vacuum is created inside the tube 80 by a vacuum source 86 coupled to one end of the tube 80. When energized the vacuum source 86 causes an air flow through the length of the tube 80 causing a pressure reduction inside the tube. This pressure reduction causes a top most sheet 68 on the stack 62 to be attracted towards the apertures 84.

In addition to separating the top most sheet 68 away from the stack 62, the transport 60 initializes movement of that sheet 68 toward the rollers 24, 26. To provide this movement, the transport 60 further comprises a rotatably mounted shaft 90 journaled for rotation about an axis coincident with the centerline of the tube 80. The shaft 90 is supported in bearings 92 mounted at opposite tube ends.

Mounted along the length of the shaft 90 are a series of turbine blades 110 which respond to fluid flow along the tube 80 by rotating the shaft 90. The orientation of the turbine blades 110 is such that air flow along the tube length rotates the shaft in a clockwise sense as seen in the FIG. 1 illustration. The radial dimension of the turbine blades 110 is slightly less than the inside diameter of the tube 80 to prevent the blades 110 from contacting the tube's flat bottom surface 82.

Spaced at locations between the turbine blades 110 are three beater blades 112 which are connected to and rotate with the shaft 80. The beater blades 112 extend radially away from the shaft 90 a distance greater than the inside diameter of the tube 80. To accomodate the beater blades 112 a slot or region of increased diameter 114 has been machined into the tube 80 which allows unimpeded rotation of those blades 112. The beater blades 112 are aligned with the apertures 84 and are of such a length that they periodically extend a distance beyond the flat tube surface 82 as they are driven by the rotating shaft 90. In the preferred embodiment of the invention, the blades 112 are equally spaced about the shaft so that each 120° revolution of the shaft 90 causes a beater blade to extend through its associated aperture 84.

The above described configuration provides a simplified drive mechanism for initializing sheet movement away from the stack 62. Rotational motion of the shaft causes the sheet 68 to be driven away from the stack since that sheet 68 is periodically contacted by the rotating beater blades 112. Accordingly, a single source of power, i.e., the vacuum source 86 attracts the sheet 68 away from the stack and also by rotating the shaft 90 drives the sheet 68 away from the stack to the rollers 22, 24.

The driving and/or the sheet attraction forces can be adjusted to suit a particular application. By reducing the number of beater blades, for example, the driving force can be reduced while the attraction force is maintained. Thus, in the FIG. 3 embodiment only alternate apertures along the tube 80 have beater blades 114 mounted to extend therethrough and contact the sheet 68. A more powerful vacuum can be used to increase the fluid flow rate through the tube to speed sheet separation for high throughput applications. Sheet feeding can be terminated by stopping the vacuum source 86 so that the shaft 90 ceases its rotation and the sheets are no longer attracted from the stack 62.

The shaft 90, turbine blades 110 and beater blades 112 are all constructed from a light weight material, which in the preferred embodiment comprises a polyethylene plastic material. Since vacuum sources are often used in a xerographic copier environment to provide other transport functions, the present transport design will typically require no additional vacuum source with the possible requirement, however, that a larger vacuum source be designed into the copier.

While a preferred embodiment of the invention has been described with a degree of particularity, it should be appreciated that certain modifications apparent to one skilled in the art could be made to the present design. Thus, the transport 10 could be used as a bottom feeder if an air flow mechanism is aimed at the stack 62 to reduce normal downward forces on the bottom sheet exerted by the remainder of the stack while allowing the bottom most sheet to be driven by the beater blades 112. It is accordingly the intent that all such modifications falling within the spirit or scope of the appended claims be covered by the present invention.

I claim:

1. Sheet feeding apparatus comprising:

a cylindrical tube mounted in relation to a sheet supply, said tube defining one or more openings positioned along its length opposite said supply;

means for creating a pressure reduction inside said tube to attract individual sheets to said tube openings; and drive means for moving sheets away from the supply having a shaft centrally mounted in said tube which supports at least one radially extending blade so that said blade extends through said one or more openings during each revolution of said shaft to contact each attracted sheet, and a number of turbine blades mounted to said shaft which respond to said means for creating a pressure reduction by rotating said shaft.

2. An automatic sheet feeder comprising:

a tube having a cut away portion along its length, a shaft mounted in said tube for rotation therein, a plurality of fan blades mounted to said shaft, a plurality of beater blades mounted on said shaft in spaced fashion extending through said cut away portion, and a source of reduced air pressure for causing a fluid flow through said tube to drive said fan blades and rotate said beater blades, thereby attracting a sheet to said cut away portion and periodically driving said sheet along a desired path with said beater blades.

3. The sheet feeder of claim 2 wherein said shaft, fan blades and beater blades comprise a lightweight plastic material.

4. In a xerographic copier, a combined sheet separator and feeder comprising a tube forming a hollow passageway positioned opposite a stack of copy sheets, the tube having at least one aperture therethrough facing said stack, means for creating a pressure reduction inside said passageway to attract individual sheets to said aperture, said drive means rotatably supported inside said passageway having a shaft centrally mounted in said passageway, a blade mounted to said shaft extending through said aperture to contact a sheet attracted to said tube and one or more turbine blades also mounted to said shaft responsive to the means for creating a pressure reduction to rotate the shaft and cause said blade to move individual sheets away from said stack.

* * * * *

UNITED STATES PATENT AND TRADEMARK OFFICE

CERTIFICATE OF CORRECTION

PATENT NO. : 4,348,021

DATED : September 7, 1982

INVENTOR(S) : David M. Montes

It is certified that error appears in the above-identified patent and that said Letters Patent are hereby corrected as shown below:

Claim 4, line 27, the word "said" in the second instance should be corrected to —and—.

Signed and Sealed this

*Seventh* Day of *December 1982*

[SEAL]

*Attest:*

GERALD J. MOSSINGHOFF

*Attesting Officer*

*Commissioner of Patents and Trademarks*